US008008533B2

(12) United States Patent
Argo et al.

(10) Patent No.: US 8,008,533 B2
(45) Date of Patent: Aug. 30, 2011

(54) PROCESS FOR REGASIFYING A GAS HYDRATE SLURRY

(75) Inventors: Carl Boles Argo, Woking (GB); Roger Neil Harper, Kingston (GB); David Charles King, Amersham (GB); Michael Bernard Power, London (GB); Peter Willcox, Beaconsfield (GB)

(73) Assignee: BP Exoloration Operating Company Limited, Middlesex (GB)

( * ) Notice: Subject to any disclaimer, the term of this patent is extended or adjusted under 35 U.S.C. 154(b) by 422 days.

(21) Appl. No.: 12/085,965

(22) PCT Filed: Nov. 22, 2006

(86) PCT No.: PCT/GB2006/004361
§ 371 (c)(1),
(2), (4) Date: Jun. 3, 2008

(87) PCT Pub. No.: WO2007/066071
PCT Pub. Date: Jun. 14, 2007

(65) Prior Publication Data

US 2009/0230025 A1 Sep. 17, 2009

(30) Foreign Application Priority Data

Dec. 6, 2005 (EP) ..... 05257496

(51) Int. Cl.
*C10G 33/00* (2006.01)

(52) U.S. Cl. ..... 585/15

(58) Field of Classification Search ..... 585/15
See application file for complete search history.

(56) References Cited

U.S. PATENT DOCUMENTS 5,816,280 A 10/1998 Rojey et al.
(Continued)

FOREIGN PATENT DOCUMENTS

GB 2 301 839 12/1996
(Continued)

OTHER PUBLICATIONS

Selim, M.S. et al. (1989). AIChE Journal, 35(6), 1049-1052.*
(Continued)

*Primary Examiner* — Walter Griffin
*Assistant Examiner* — Brian McCaig
(74) *Attorney, Agent, or Firm* — Nixon & Vanderhye

(57) ABSTRACT

Continuous process for regasifying a feed stream having (i) a slurry phase comprising gas hydrate particles suspended in a produced liquid hydrocarbon and optionally free produced water and (ii) optionally a gaseous phase comprising free produced gaseous hydrocarbon thereby generating a regasified multiphase fluid and for separating the regasified multiphase fluid into its component fluids. The method includes (a) heating the feed stream to above the dissociation temperature of the gas hydrate thereby regasifying the feed stream by converting the gas hydrate particles into gaseous hydrocarbon and water, (b) separating a gaseous hydrocarbon phase from the regasified multiphase fluid thereby forming a gaseous hydrocarbon product stream and a liquid stream comprising a mixture of liquid hydrocarbon and water, (c) separating the liquid stream comprising a mixture of the liquid hydrocarbon and water into a liquid hydrocarbon phase and an aqueous phase; and (d) removing the liquid hydrocarbon phase as a liquid hydrocarbon product stream. The regasification production facility additionally has a concentrator vessel and the feed stream is passed to the concentrator vessel prior to being heated in step (a) to above the dissociation temperature of the gas hydrate particles wherein a gaseous phase comprising free gaseous hydrocarbon separates from the feed stream in the concentrator vessel and is removed from the concentrator as a gaseous hydrocarbon stream.

22 Claims, 4 Drawing Sheets

U.S. PATENT DOCUMENTS

| | | | | |
|---|---|---|---|---|
| 5,877,361 | A * | 3/1999 | Rojey et al. | 585/15 |
| 5,941,096 | A | 8/1999 | Gudmundsson | |
| 6,028,235 | A * | 2/2000 | Heinemann et al. | 585/15 |
| 6,774,276 | B1 | 8/2004 | Lund et al. | |

FOREIGN PATENT DOCUMENTS

| | | | |
|---|---|---|---|
| WO | 96/34227 | | 10/1996 |
| WO | 97/24550 | | 7/1997 |
| WO | WO 97/24550 | A1 | 7/1997 |
| WO | 97/40307 | | 10/1997 |
| WO | WO 97/40307 | A1 | 10/1997 |
| WO | 01/49639 | | 7/2001 |
| WO | 02/101277 | | 12/2002 |

OTHER PUBLICATIONS

Gudmundsson, J.S., et al; II SPE 56629; "NGH on FPSO—Slurry Process and Cost Estimate"; *Society of Petroleum Engineers*; 8 pgs (D1).

Frontiers, The BP Magazine of Technology and Innovation; Dec. 2004, 6 pgs (D6).

BP Global—Reports and publications—Delving Deeper; *Frontiers 2004 Archive*, Issue No. 11, pp. 1-10 (2004).

Sloan, Jr., E.D., "Clathrate Hydrates of Natural Gases"; *Exxon Production Research Company*; 11 pgs (D8).

Ostergaard, K.K., et al; SPE 50689; "Effect of Reservoir Fluid Production on Gas Hydrate Phase Boundaries"; pp. 507-514 (D9).

International Search Report for PCT/GB2006/004361, mailed Mar. 8, 2007.

Written Opinion of the International Searching Authority for PCT/GB2006/004361, mailed Mar. 8, 2007.

* cited by examiner

PROCESS FOR REGASIFYING A GAS HYDRATE SLURRY

This application is the U.S. national phase of International Application No. PCT/GB2006/004361, filed 22 Nov. 2006, which designated the U.S. and claims priority to Europe Application No. 05257496.9, filed 6 Dec. 2005, the entire contents of each of which are hereby incorporated by reference.

The present invention relates to a method of regasifying a multiphase fluid comprising a hydrate slurry and free gaseous hydrocarbon and/or free liquid hydrocarbon, at an offshore production facility or at an on-shore receiving terminal.

BACKGROUND OF THE INVENTION

The search for new oil or gas resources has now reached a stage where it is moving away from relatively easily accessible continental shelf waters and towards deeper waters. This gives rise to technical challenges including the problem of gas hydrate deposition in pipelines and in production facilities. Gas hydrate is an ice-like compound consisting of light hydrocarbon molecules encapsulated in an otherwise unstable water crystalline structure. These gas hydrates form at high pressure and low temperature wherever a suitable gas and free water are present. Gas hydrate crystals can deposit on pipelines walls and in a production facility, and in worst case scenarios can lead to complete blockage of pipelines or the vessels and flow lines of the production facility. Although gas hydrate formation is a major problem for gas production, the formation of gas hydrates is also a problem for gas condensate and crude oil production.

There is a growing understanding in the oil and gas industry that gas hydrate particles in a flow situation are not necessarily a problem per se. If the particles do not deposit on pipeline walls or equipment and do not have a significant impact on fluid flow behavior (i.e. their concentration is not too high), the particles simply flow with the rest of the fluids. Thus, U.S. Pat. No. 6,774,276 describes a method for transporting a flow of fluid hydrocarbons containing water through a treatment and transportation system including a pipeline, the method comprising:

introducing the flow of fluid hydrocarbons into a reactor wherein the flow of fluid hydrocarbons contains water;

introducing a cold fluid flow of hydrocarbons, containing particles of gas hydrates acting as a hydrophilic agent, into the reactor where it is mixed with the flow of fluid hydrocarbons containing water;

cooling an effluent flow of hydrocarbons from the reactor in a heat exchanger to ensure that free water present therein attains the form of gas hydrates;

treating the cooled effluent flow in a separator to separate the flow into a first flow and a second flow, wherein the first flow has a content of gas hydrate;

recycling the first flow to the reactor to provide the particles of gas hydrate; and conveying the second flow to a pipeline to be transported to a destination.

By seeding the flow with gas hydrate particles, hydrate growth takes place on the seed particles. The gas hydrate particles increase in size but remain entrained in the flow and therefore do not deposit on the walls of the pipeline. The gas hydrate particles will not melt back to free the water and natural gas until temperatures rise or pressures become too low —which in reality will be at the end of the pipeline. According to U.S. Pat. No. 6,774,246, the hydrate powder can be mechanically separated from the bulk liquid phase by a sieve. Another method would be to melt the hydrates in a separator where the residence time is long enough for the emerging water to separate out from the hydrocarbon liquids. Also, depending on the fluid system, the particle density may even deviate enough from the bulk liquid so that the particles may easily be separated off. However, there remains a need for an improved process for the regasification of gas hydrate particles that are entrained in a multiphase produced fluid.

International patent application number WO 97/24550 relates to a terminal plant and a method according to which a hydrocarbon product which may consist of only hydrate or may consist of a suspension of a carrier liquid and gas hydrate suspended therein, is potentially stored for a certain time before being dissociated so that a gas is generated for further transport or use. The hydrocarbon product is stored within one or several storing tanks at a temperature so low and stable that the hydrate is maintained in form of hydrate at the storing pressure which possibly may be very close to the normal atmospheric pressure. This allows the storage tank or tanks to be built without any reinforcing structures and thick walls. Such storing tanks are used in a plant together with at least one dissociation tank which may have a much smaller volume than the storing tank or tanks, and such dissociated tank or tanks are dimensioned to withstand a pressure which corresponds to the degasification pressure for the released gas when the hydrate dissociates, which in practical terms means a pressure of approximately 50 to 60 bars. It is said to be advantageous if the hydrocarbon product is in the form of a suspension comprising relatively small particles of gaseous hydrate suspended in a carrier liquid which preferably consists of hydrocarbon liquid or of a mixture of different hydrocarbon liquids, preferably mainly of a non-hydrate-forming nature. One of the objects of the carrier fluid is to give buoyancy to the gas hydrate particles which substantially reduces or completely prevents the tendency of compaction of the hydrate in the lower parts of the storing tank. In contrast, the present invention does not store the multiphase fluid that contains the gas hydrate particles within a storage tank prior to regasifying the gas hydrate particles. In addition, the process of WO 97/24550 is not capable of handling the large volumes of gaseous hydrocarbon and liquid hydrocarbon that are formed in the process of the present invention.

SUMMARY OF THE INVENTION

The present invention relates to a continuous process for regasifying a feed stream comprising (i) a slurry phase comprising gas hydrate particles suspended in a produced liquid hydrocarbon and optionally free produced water and (ii) optionally a gaseous phase comprising free produced gaseous hydrocarbon thereby generating a regasified multiphase fluid and for separating the regasified multiphase fluid into its component fluids, comprising the steps of:

(a) heating the feed stream to above the dissociation temperature of the gas hydrate thereby regasifying the feed stream by converting the gas hydrate particles into gaseous hydrocarbon and water;

(b) separating a gaseous hydrocarbon phase from the regasified multiphase fluid thereby forming a gaseous hydrocarbon product stream and a liquid stream comprising a mixture of liquid hydrocarbon and water;

(c) separating the liquid stream comprising a mixture of the liquid hydrocarbon and water into a liquid hydrocarbon phase and an aqueous phase; and (d) removing the liquid hydrocarbon phase as a liquid hydrocarbon product stream.

Where the amount of gas hydrate particles in the feed stream is limited by the amount of water in the produced fluid, the feed stream may contain free gaseous hydrocarbon. By free gaseous hydrocarbon is meant gaseous hydrocarbon that is not associated with the gas hydrates. This free gaseous hydrocarbon will form a gaseous hydrocarbon phase. Where the amount of gas hydrates in the feed stream is limited by the amount of gaseous hydrocarbon in the produced fluid, the feed stream may contain free water. By free water is meant water that is not associated with the gas hydrates. It is believed that this free water will be of similar density to the slurry phase and therefore will not form a distinct aqueous phase in the feed stream. Thus, the slurry phase of the feed stream may have a relative density of 0.9 to 0.95 g/cm$^3$ while the density of the water will depend on its total dissolved salt content and may range from 0.9 to 1.6 g/cm$^3$.

Suitably, the feed stream is obtained using the process of U.S. Pat. No. 6,774,276, which is herein incorporated by reference. Thus, a flow of produced fluid hydrocarbons (gaseous hydrocarbon and liquid hydrocarbon) containing water is introduced into a reactor where it is mixed with seed particles of gas hydrates which are also introduced into the reactor and the effluent flow of hydrocarbons from the reactor is cooled in a heat exchanger so that gas hydrate grows on the surface of the seed crystals. The flow is then treated in a separator where the flow is separated into a first flow and a second flow. The first flow which has a content of gas hydrates is recycled to the reactor to provide the seed particles of gas hydrates, and the second flow is transported through a pipeline to a production facility. The flow of produced hydrocarbons containing water that is introduced to the reactor may be a multiphase fluid produced from a gas well (in which case the multiphase fluid comprises natural gas, gas condensate and water) or may be a multiphase fluid produced from an oil well (in which case the multiphase fluid comprises natural gas, crude oil, and water). The flow of the multiphase fluid will initially be relatively warm and will be under an elevated pressure. As discussed in U.S. Pat. No. 6,774,276, it is preferred to cool the multiphase fluid in a first heat exchanger before introducing the multiphase fluid into the reactor. It is also preferred to mix the multiphase fluid before the fluid enters the reactor in order to disperse the produced water in the form of droplets in the hydrocarbons (gaseous hydrocarbon and liquid hydrocarbon). It is envisaged that the second flow from the separator may be mixed with wet gas under pressure in a mixing means before the flow is conveyed to the pipeline for transportation to the production facility. Free water in the wet gas is absorbed by the dry hydrate from the separator in the mixing means and the water which moistens the dry hydrate is readily converted to further hydrate. The new hydrate that is formed will increase the size of the hydrate particles from the separator and may also form new small hydrate particles when larger hydrate particles are broken apart in the mixing means. At the outlet of the mixing means, provided there is excess gaseous hydrocarbon, all free water will have been converted to gas hydrate. Thus, the feed stream that is transported to the production facility through the pipeline comprises a flow of produced fluids having gas hydrate particles entrained therein.

The feed stream that is being transported through the pipeline to the production facility may be in a stratified flow regime. Thus, where the feed stream contains free gaseous hydrocarbon, a distinct gaseous phase may lie above a slurry phase (suspension of gas hydrate particles in a produced liquid hydrocarbon and/or produced water) in the pipeline. Alternatively, the phases of feed stream may be well mixed, such as in an annular flow regime, or misty flow regime. Where the feed stream that is being transported through the pipeline to the production facility is in a stratified slug flow regime, a large separation vessel (typically known as a slugcatcher) may be required upstream of the production facility in order to manage pipeline multiphase flow. This large separation vessel (slugcatcher) may also provide some initial separation of a gaseous hydrocarbon phase from a concentrated hydrate slurry, prior to heating the feed stream in step (a).

The production facility used for carrying out the process of the present invention (hereinafter "regasification production facility") may be at an onshore terminal, an offshore platform or a floating structure including a floating production, storage and off-take facility (FPSO). The regasification production facility typically comprises a dissociation vessel for regasifying the feed stream, at least one gas-liquid separator, at least one liquid hydrocarbon-water separator and optionally a concentrator for removing gaseous hydrocarbon from the feed stream prior to regasifying the feed stream. It is envisaged that the dissociation vessel and optional concentrator may be retrofitted to an existing production facility. The feed stream may be passed from the pipeline to the dissociation vessel of the regasification production facility using a conventional pump and flow line since the presence of the gas hydrate particles does not have a significant impact on the flow behavior of the feed stream. It is also envisaged that the regasification production facility may be heat integrated with a conventional production facility that is used for processing a conventional multiphase feed stream. By "conventional multiphase feed stream" is meant a multiphase feed stream comprising a gaseous hydrocarbon phase, a liquid hydrocarbon phase and water that is maintained at above the gas hydrate formation temperature. This conventional multiphase feed stream may flow to the conventional production facility through a heated pipeline, an insulated pipeline or a "pipe-in-pipe" line.

The feed stream to the regasification production facility comprises (i) a slurry phase comprising gas hydrate particles suspended in a produced liquid hydrocarbon and optionally free produced water and (ii) optionally a gaseous phase comprising free produced gaseous hydrocarbon. Suitably, the produced liquid hydrocarbon is a gas condensate or crude oil. Preferably, the gas hydrate particles have a mean diameter of less than 250 μm. These small gas hydrate particles do not tend to aggregate to form larger particles and therefore remain entrained in the flow of produced liquid hydrocarbon and optionally free produced water. Preferably, the concentration of gas hydrate particles in the slurry phase is less than 50% by weight.

Regasification of the gas hydrate particles of the slurry phase is achieved in step (a) by heating the feed stream such that the gas hydrate particles dissociate to free the gaseous hydrocarbon from the water that was associated with the gas hydrate and from any gas condensate or oil (lighter components of crude oil) that was trapped within the gas hydrate particles.

Preferably, the feed stream is at least partially heated in step (a) by heat exchange with one or more hot process streams that are produced in the regasification production facility and/or in the integrated conventional production facility. The hot process stream may be selected from:

(1) The hot regasified gaseous hydrocarbon stream;

(2) A hot compressed gaseous hydrocarbon stream from the regasification production facility and/or the integrated conventional production facility (thereby making use of heat of compression);

(3) A hot produced water stream from a liquid hydrocarbon-water separator of the regasification production facility and/or the integrated conventional production facility;

(4) A hot liquid hydrocarbon product stream from a liquid hydrocarbon-water separator of the regasification production facility and/or the integrated conventional production facility; and (5) A hot exhaust from a gas turbine of the regasification production facility and/or the integrated conventional production facility (where the gas turbine is used to generate electricity, for example, for driving the gas compressors or other processing equipment).

Where the feed stream is at least partially heated in step (a) by heat exchange with one or more hot process streams, it is preferred that this heat exchange provides 5 to 100%, more preferably, 10 to 90%, most preferably 25 to 75%, for example, 45 to 55% of the heat input required to raise the temperature of the feed stream to at or above the dissociation temperature of the gas hydrate particles.

Generally, it will be necessary to heat the feed stream in the dissociation vessel to at or above the dissociation temperature of the gas hydrate particles (unless heat exchange of the feed stream with the hot process stream(s) provides 100% of the heat input required to regasify the gas hydrate particles). Preferably, the feed stream is heated to a temperature of at least 15° C., preferably at least 25° C., for example, at least 30° C. in the dissociation vessel. Where the feed stream comprises a waxy crude oil, it is preferred that the feed stream is heated in the dissociation vessel to a temperature above the wax formation temperature. Typically, the wax formation temperature is in the range 20 to 50° C., for example about 40° C.

Preferably, the feed stream is reduced in pressure before being fed to the dissociation vessel thereby facilitating regasification of the gas hydrate particles. Typically, the feed stream is fed to the dissociation vessel at a pressure in the range 10 to 100 bar absolute, for example, 20 to 40 bar absolute.

Suitably, the residence time of the feed stream in the dissociation vessel is in the range 0.25 to 30 minutes, preferably 3 to 15 minutes, for example, 3 to 10 minutes.

The dissociation vessel may be a regasification boiler that heats the feed stream by heat exchange with a hot heat exchange fluid, for example, hot oil, hot gas or steam. In particular, the regasification boiler may be a "thermo-siphon" comprising a heat exchanger vessel, piping and a feed vessel arranged upstream of the heat exchanger vessel wherein the head of the feed stream in the feed vessel provides the motive force to move the feed stream from the feed vessel to the heat exchanger vessel and to maintain a steady liquid level in the heat exchanger. Warm vapour and liquid from the heat exchanger vessel is either recycled back to the feed vessel or is passed to separation equipment arranged downstream of the heat exchanger vessel. The steam or hot gas that is used to heat the regasification boiler may be obtained by utilizing waste heat from the regasification production facility and/or an integrated conventional production facility. Also, the regasification boiler may be a "kettle" type reboiler, which is a large vessel having a heat exchange coil located therein. This kettle type reboiler may be equipped with a recycle pump (also known as a pump-around), which can be used to increase the residence time of the feed within the reboiler. In addition, the recycle pump assists in flowing the feed through the reboiler and ensures good mixing. Alternatively, the dissociation vessel may be a warm water mixing vessel in which warm water is fed to a tank that is provided with a stirring means, for example, a paddle stirrer, in order to heat up the slurry phase to above the dissociation temperature for the gas hydrate. Suitably, the warm water enters the mixing vessel at a temperature in the range 40 to 95° C., preferably 50 to 60° C. Preferably, the warm water is a hot produced water stream from the regasification production facility and/or from an integrated conventional production facility. It is also envisaged that the dissociation vessel may be a steam sparger vessel. Mixing of the feed stream with the steam may be achieved by the act of sparging steam into the vessel. However, if necessary, the steam sparger vessel may be provided with an additional stirring means, for example, a paddle stirrer. The steam that is sparged into the dissociation vessel is preferably at a pressure in the range 30 to 60 bar absolute, for example, 50 bar absolute. Suitably, the steam may be sparged into the vessel via at least one nozzle, for example, 1 to 10 nozzles, preferably, 1 to 5 nozzles. Preferably, the nozzle(s) is positioned in the upper portion of the dissociation vessel. The steam outlet of the nozzle(s) is preferably below the liquid level in the steam sparger vessel.

Where the dissociation vessel is a regasification boiler, a regasified multiphase fluid stream is withdrawn from the regasification boiler and is passed to a gas-liquid separator (for example, a separator drum) where a gaseous phase separates from the liquid components of the regasified multiphase fluid. A gaseous stream is withdrawn overhead from at or near the top of the gas-liquid separator and a liquid stream comprising a mixture of liquid hydrocarbon and water may be withdrawn from at or near the bottom of the gas-liquid separator.

Where the dissociation vessel is a warm water mixing vessel or a steam sparger vessel, a gaseous stream may be withdrawn overhead from at or near the top of the dissociation vessel and a liquid stream comprising a mixture of liquid hydrocarbon and water may be withdrawn from at or near the bottom of the dissociation vessel. In other words, the dissociation vessel also acts as a gas-liquid separator.

The gaseous stream from the gas-liquid separator or from the dissociation vessel comprises a major portion of the gaseous phase from the regasified multiphase fluid. This gaseous phase typically comprises gaseous hydrocarbon that was associated with the gas hydrate particles, any free gaseous hydrocarbon that was present in the feed stream, and vaporized hydrocarbons.

Preferably, the feed stream is passed to a concentrator prior to being heated to above the dissociation temperature for the gas hydrate particles in the dissociation vessel. Suitably, the concentrator is a hydrocyclone or settling vessel. It is envisaged that where there is free gaseous hydrocarbon in the feed stream that a gaseous phase may separate from the feed stream in the concentrator. Accordingly, a gaseous stream may be withdrawn from the concentrator thereby reducing the heat input requirements to the dissociation tank. In addition, an aqueous slurry phase or a liquid hydrocarbon slurry phase may be withdrawn from the concentrator thereby further reducing the heat input requirements to the dissociation tank. This is illustrated with respect to a feed stream that is formed by cooling a produced fluid from an oil well to below the gas hydrate formation temperature. Early in the life of the oil well, the produced fluid may comprise gaseous hydrocarbons, a major portion of crude oil and a minor portion of produced water. Accordingly, an aqueous slurry phase comprising gas hydrate particles suspended in produced water may separate from the feed stream in the concentrator. This aqueous slurry phase may be withdrawn from the concentrator and may be passed to an aqueous slurry dissociation vessel where the aqueous slurry is heated to above the dissociation temperature of the gas hydrate particles thereby forming a gaseous hydrocarbon phase and a produced water phase. Any residual oil that is present in the produced water phase may be removed by passing the produced water to an electrostatic coalescer. It is also envisaged that water may be added to the feed stream in the concentrator to assist in separating out the aqueous slurry phase. Later in the life of the oil well, the produced fluid may comprise gaseous hydrocarbons, a minor portion of crude oil and a major portion of produced water. Accordingly, an oil slurry phase may separate out from the feed stream wherein the oil slurry phase comprises a suspension of gas hydrate particles in crude oil. This oil slurry phase may be withdrawn from the concentrator and may be passed to an oil slurry dissociation vessel where the oil slurry is heated to above the dissociation temperature of the gas hydrate particles thereby forming a gaseous hydrocarbon phase and an oil phase. Any residual water in the oil phase may be removed in downstream separation equipment. In both cases, the remaining slurry is passed from the concentrator to the dissociation vessel, preferably, after being heat exchanged with at least one hot process fluid. Removal of the aqueous slurry phase or the oil slurry phase from the concentrator reduces the heat input requirements to the dissociation vessel.

Where the dissociation vessel is a regasification boiler, the gaseous stream that is withdrawn from the concentrator may be introduced to the gas-liquid separator together with the regasified multiphase fluid from the regasification boiler. Preferably, the gaseous phase from the concentrator may be introduced to the gas-liquid separator separately from the regasified multiphase fluid. However, it is also envisaged that the gaseous phase may be commingled with the regasified multiphase fluid upstream of the gas-liquid separator.

Where the dissociation vessel is a warm water mixing vessel or a steam sparger vessel, the gaseous stream that is removed from the concentrator may be commingled with the gaseous stream that is withdrawn from the dissociation vessel and the combined gaseous stream may be passed to a gas-liquid separator.

Preferably, a plurality of gas-liquid separators are arranged in series, for example, 2 to 4, preferably 3 gas-liquid separators arranged in series. The process of the present invention will now be illustrated by reference to 3 gas liquid separators arranged in series. Suitably, a gaseous stream is removed overhead from at or near the top of the first gas-liquid separator in the series and is cooled by being passed through a heat exchanger, for example, by heat exchange with the feed stream. The liquid that condenses out of the cooled gaseous stream is separated in the second gas-liquid separator in the series. A gaseous stream is removed overhead from at or near the top of the second gas-liquid separator and is compressed in a compressor to generate a high pressure gaseous stream and this stream is then cooled by being passed through a heat exchanger, for example, by heat exchange with the feed stream. The liquid that condenses out from the cooled high pressure gaseous stream is separated in the third separation vessel in the series. The gaseous stream that is withdrawn overhead from the third separator in the series may be combined with the gaseous stream(s) withdrawn from the liquid hydrocarbon-water separator(s) (see below) and the resulting gaseous hydrocarbon product stream may be further compressed, for example, to a pressure of at least 60 bar absolute, preferably at least 80 bar absolute before being sent to a gas pipeline. Typically, the gaseous hydrocarbon product stream is natural gas. A liquid stream comprising a mixture of liquid hydrocarbon and water is withdrawn from at or near the bottom of each of the separators in the series (and from the dissociation vessel where the dissociation vessel acts as a gas-liquid separator). These liquid streams are combined and the combined liquid stream is separated into a liquid hydrocarbon phase and an aqueous phase in step (c)

The liquid hydrocarbon phase that is separated in step (c) of the present invention comprises any gas condensate or components of crude oil that were associated with the gas hydrate particles and any free gas condensate or crude oil that was present in the feed stream. The aqueous phase that is separated in step (c) comprises produced water that was associated with the gas hydrate particles and any free produced water that was present in the feed stream.

Suitably, step (c) of the process of the present invention is carried out in at least one liquid hydrocarbon-water separator. If necessary, the liquid stream comprising a mixture of liquid hydrocarbon and water from step (b) is heated prior to being fed to the first liquid hydrocarbon-water separator in the series in order to assist in separating the aqueous phase from the liquid hydrocarbon phase. Typically, the liquid stream from step (b) may be heated to a temperature in the range 40 to 90° C., preferably, 55 to 65° C. prior to being passed to the liquid hydrocarbon-water separator. Preferably, a plurality of liquid hydrocarbon-water separators are arranged in series, for example, 2 to 6, preferably 3 to 4 arranged in series. Thus, the liquid stream from step (b) of the present invention is fed to the first of the plurality of liquid hydrocarbon-water separators that are arranged in series. Suitably, the pressure of the first liquid hydrocarbon-water separator in the series is in the range 5 to 30 bar absolute, preferably, 7 to 15 bar absolute. Suitably, the operating pressure of the second and successive separators in the series is less than the operating pressure of the first and preceding separator in the series respectively with the proviso that the feed to the final separator in the series may be pumped to an elevated pressure. The operation of the liquid hydrocarbon-water separators will now be illustrated with respect to 3 liquid hydrocarbon-water separators arranged in series. In the first liquid hydrocarbon-water separator, the liquid stream comprising a mixture of liquid hydrocarbon and water separates into an upper liquid hydrocarbon phase and a lower aqueous phase. Degassing of the liquid stream results in a gaseous phase separating into the head space of the first liquid hydrocarbon-oil separator. Accordingly, a gaseous stream is withdrawn overhead from at or near the top of the first liquid hydrocarbon-water separator. A liquid stream comprising liquid hydrocarbon (gas condensate or crude oil) and a minor amount of water is withdrawn from an intermediate position from the first separator and is heated in a heat exchanger (by heat exchange with, for example, hot oil, air or steam) to a temperature of at least 60° C. before being reduced in pressure and introduced into the second liquid hydrocarbon-water separator in the series. In this second separator, further aqueous phase separates from a liquid hydrocarbon phase. Degassing of the liquid stream results in a gaseous phase separating into the head space of the second separator. Accordingly, a gaseous stream is withdrawn overhead from at or near the top of the second separator. Suitably, a liquid hydrocarbon stream having a reduced content of water may be withdrawn at an intermediate position from the second separator and is pumped to a third (final) separator in the series where degassed and dried liquid hydrocarbon is withdrawn from an intermediate position. This final separator in the series does not have a gaseous take-off. The dehydrated and degassed liquid hydrocarbon product stream (gas condensate or crude oil) may be pumped to export (to a tanker or pipeline). An aqueous stream is removed from at or near the bottom of each of the separators in the series. Suitably, these aqueous streams are combined and after removal of any hydrocarbon contaminant, the combined aqueous stream may be discharged to the environment. Alternatively, the combined aqueous streams may be employed as injection water. Suitably, the gaseous streams that are withdrawn from the first and second liquid hydrocarbon-water separators are combined with the gaseous stream from the final gas-liquid separator (see above) and therefore comprise part of the gaseous product stream.

BRIEF DESCRIPTION OF THE DRAWINGS

The process of the present invention will now be described with reference to the FIGS. 1 to 4.

DETAILED DESCRIPTION OF PREFERRED EMBODIMENTS

Figure 1:
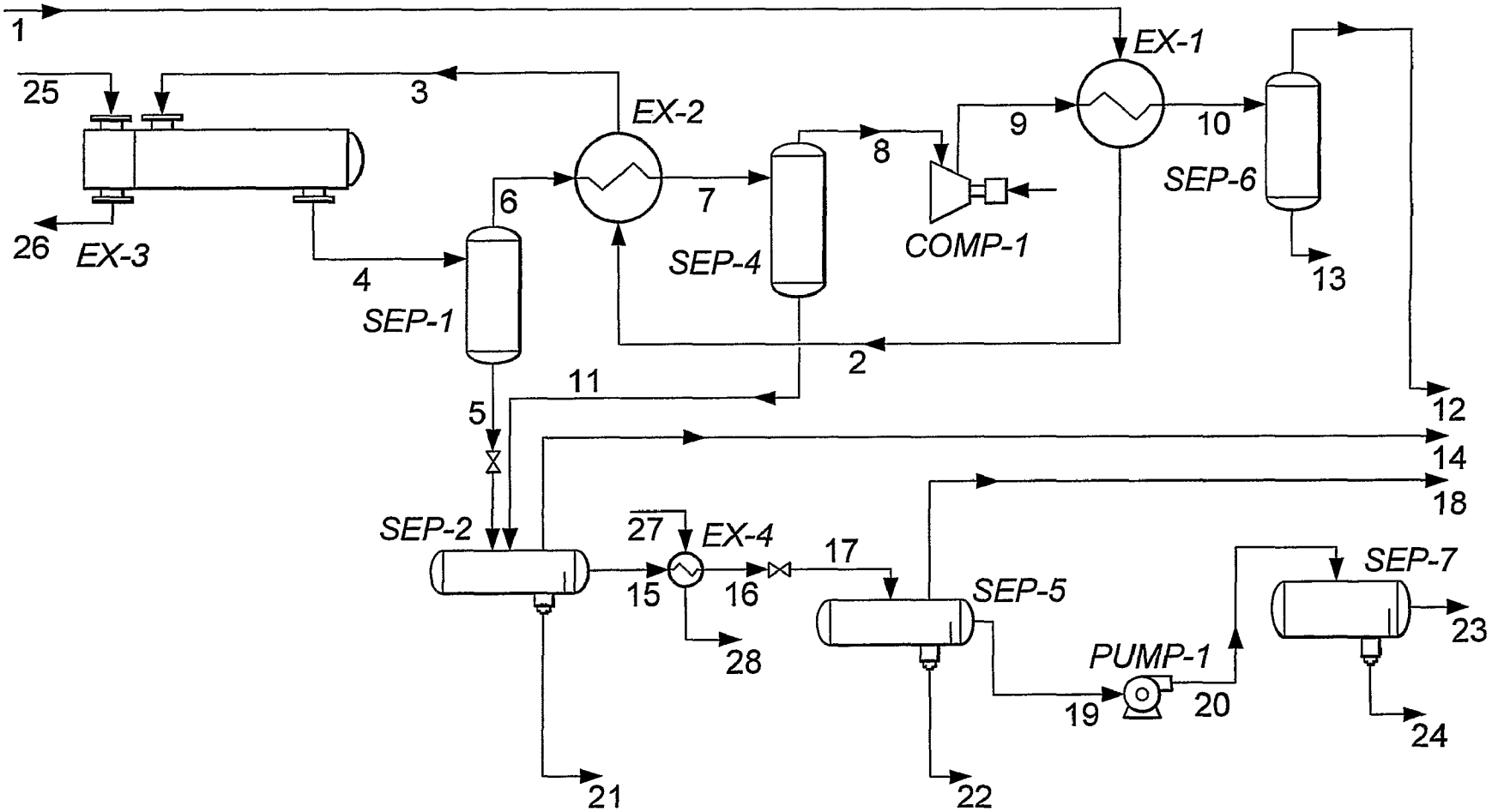

In FIG. 1, a feed stream comprising a gas hydrate slurry 1 is warmed by heat exchange with hot process streams 9 and 6 (discussed later) in heat exchangers EX-1 and EX-2 and optionally with hot process streams 22 and 23 (this optional heat exchange is not shown) before being fed to re-gasification boiler EX-3 where the slurry is heated (by heat exchanger with hot oil or with hot air or steam produced from waste heat) to heat and re-gasify the hydrate particles contained within the slurry. The resulting fluid mixture is passed to separator SEP-1 where a gaseous phase 6 is removed from the top of the separator and a liquid phase 5 from the bottom of the separator.

The gaseous phase is cooled in heat exchanger EX-2 and is then passed to separator SEP-4 where any liquid that condenses out of the gaseous phase in EX-2 is separated from the remaining gaseous phase (streams 11 and 8 respectively). The gaseous phase 8 is compressed in compressor COMP-1 to form a high pressure gaseous stream 9 that is cooled in heat exchanger EX-1. Any liquid that condenses out of stream 9 is removed from the bottom of SEP-6 (stream 13). The remaining gaseous product is removed from the top of SEP-6 via line 12.

The liquid phases withdrawn from separators SEP-1, SEP-4 and optionally SEP-6 via lines 5, 11 and 13 are passed to the first of 3 oil-water separators that are arranged in series (SEP-2, SEP-5 and SEP-7). A gaseous phase is removed overhead from both SEP-2 and SEP-5 (streams 14 and 18), and an aqueous phase from the bottom of each of the separators SEP-2. SEP-5, and SEP-7 (streams 21, 22, 24) for disposal. The oil phase from SEP-2 is passed through heat exchanger EX-4 where the stream is heated against stream 27 (hot Oil or another suitable heating medium such as hot air or stream) before being passed to separator SEP-5. The oil phase from SEP-5 is passed via lines 19 and 20 and PUMP-1 to SEP-7. A dehydrated and degassed oil phase is removed from SEP-7 via line 23.

If necessary a large separation vessel may be provided upstream of the separation facility, to collect the fluids prior to processing (typically known as a slugcatcher). The slugcatcher is used to manage pipeline multiphase flow, and in particular, to prevent the separation facility from becoming overwhelmed by a large slug of hydrate slurry during periods of slug flow.

Figure 2:
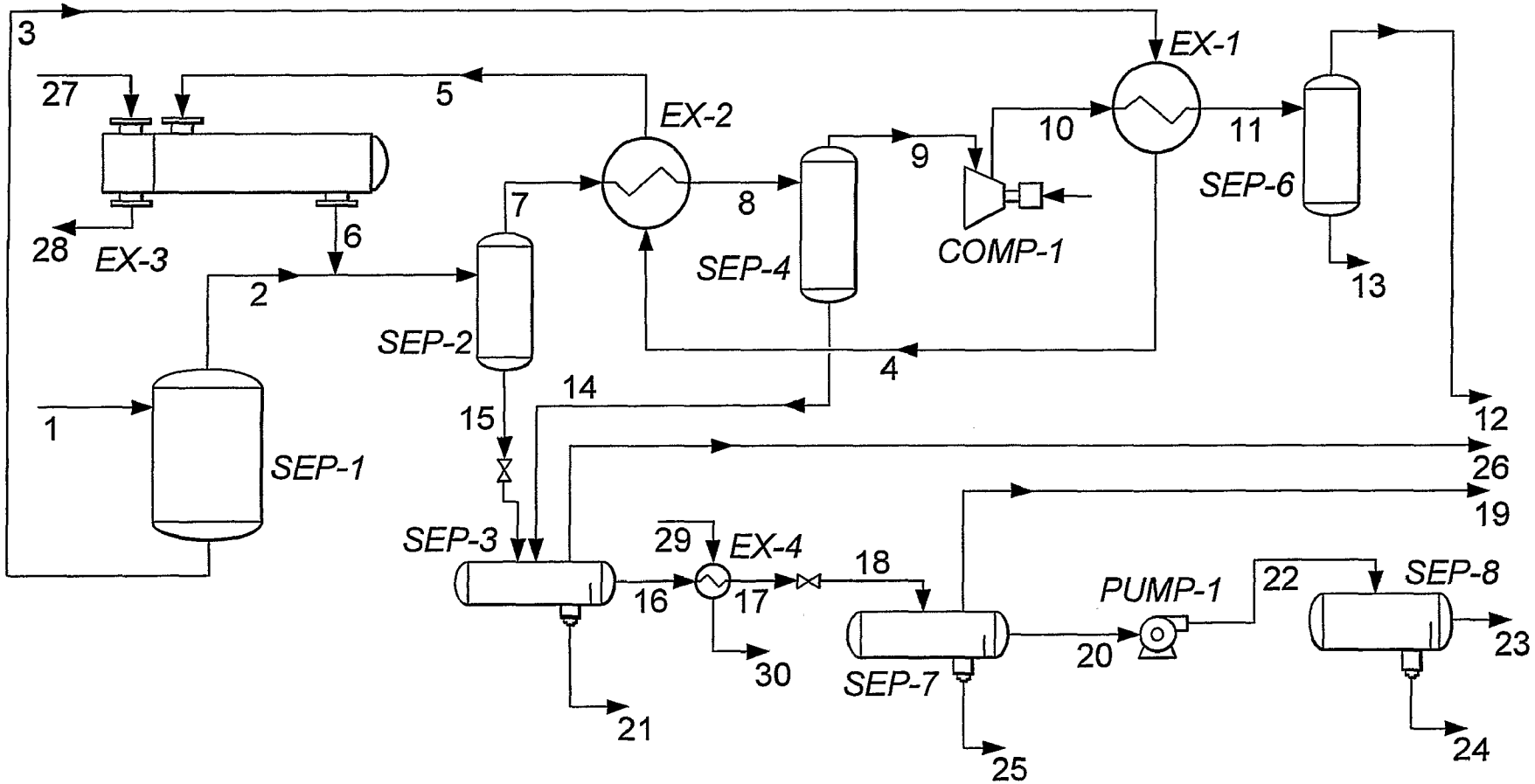

In FIG. 2, a feed stream comprising a gas hydrate slurry 1 is fed to a slurry concentration vessel (for example, a cyclone, settling vessel or slugcatcher), which separates a concentrated hydrate slurry 3 from a gaseous hydrocarbon phase 2. It is also envisaged that an oil slurry phase may separate from the hydrate slurry and may be withdrawn from SEP-1 at an intermediate position (the oil slurry phase will separate from the concentrated hydrate slurry as an upper slurry phase). This concentration step will minimize or reduce the heat input requirements to disassociate the hydrate slurry. The gaseous hydrocarbon phase 2 from SEP-1 is co-mingled with the disassociated hydrate slurry 6 from regasification boiler EX-3 (discussed below) before being passed to SEP-2. Suitably, a portion of the concentrated hydrate slurry 3 is recycled to the slurry concentration vessel via a recycle pump (not shown) to enhance separation of the gaseous hydrocarbon phase.

The concentrated slurry stream from SEP-1 is warmed by heat exchange with hot process streams 10 and 7 (described below) in heat exchangers EX-1 and EX-2 and optionally with hot process streams 25 and 23 (this optional heat exchange is not shown) before being fed to re-gasification boiler EX-3 where the slurry is heated (by heat exchange with hot oil or with hot air or steam generated using waste heat) to heat and re-gasify the hydrate particles contained within the slurry. The resulting fluid mixture is passed to separator SEP-2 (together with the gaseous hydrocarbon phase 2 from SEP-1) where a gaseous phase 7 and a liquid phase 15 are removed from the top and bottom of the separator SEP-2 respectively. The gaseous phase 7 is cooled in heat exchanger EX-2 against the concentrated slurry stream 3 and is then passed to separator SEP-4 via line 8 where any liquid that condenses out of the gaseous phase in EX-2 is separated from the remaining gaseous phase (streams 14 and 9 respectively).

The gaseous phase 9 is compressed in compressor COMP-1 to form a high pressure gaseous stream 10 that is cooled in heat exchanger EX-1 against the concentrated slurry stream 3. Any liquid that condenses out of stream 11 is removed from the bottom of SEP-6 (stream 13). The remaining gaseous product is removed from SEP-6 via line 12.

The liquid phases from separators SEP-2, SEP-4 and optionally SEP-6 (streams 15, 14 and optionally 13) are passed to the first of 3 oil-water separators that are arranged in series (SEP-3, SEP-7 and SEP-8). A gaseous phase is removed overhead from both SEP-3 and SEP-7 (streams 26 and 19), and an aqueous phase from the bottom of each of the separators (streams 21, 25, 24). The oil phase from SEP-3 (stream 16) is passed through heat exchanger EX-4 where the stream is heated against stream 29 (hot oil or another suitable heating medium such as hot air or steam) before being passed to separator. SEP-7. The oil phase from SEP-7 is passed via lines 20 and 22 and PUMP-1 to SEP-8. A dehydrated and degassed oil phase is removed from SEP-8 via line 23.

A large separation vessel may be required upstream of the slurry separation facility, to collect the multiphase fluids prior to processing (typically known as a slugcatcher) in order to manage pipeline multiphase flow.

Figure 3:
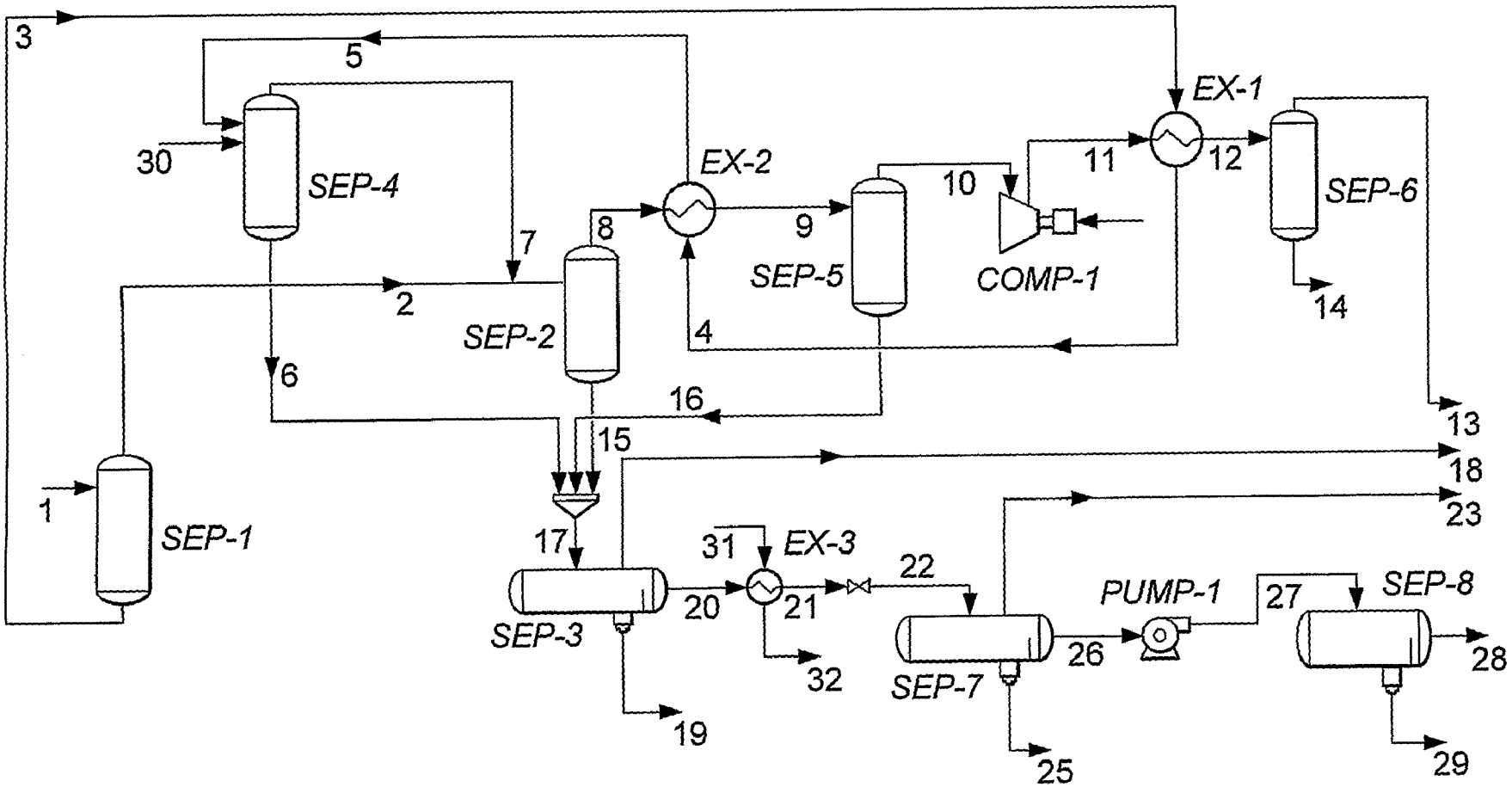

In FIG. 3, a feed stream comprising a gas hydrate slurry 1 is fed to a SEP-1 which is slurry concentration vessel (for example, a cyclone or settling vessel), where a concentrated hydrate slurry (stream 3) is separated from a gaseous hydrocarbon stream 2, as described above with respect to FIG. 2. The gaseous phase 2 from SEP-1 is co-mingled with the gaseous phase (stream 7) from disassociated hydrate slurry and the combined stream is introduced to SEP-2

The concentrated slurry stream 3 from SEP-1 is warmed by heat exchange with hot process streams 11 and 8 in heat exchangers EX-1 and EX-2 and optionally with hot process stream 28 (this optional heat exchange is not shown) before being fed to a warm water mixing vessel SEP-4 where the slurry is contacted with warm water (stream 30) to heat and re-gasify the hydrate particles contained within the slurry. Stream 30 may be hot produced water stream from SEP-7 (i.e. stream 25 may be recycled to SEP-4) or may be a hot produced water stream from an integrated conventional production facility. Suitably, the mixture of slurry and added warm water is stirred within the mixing vessel SEP-4. A liquid stream 6 is removed from the bottom of the mixing vessel SEP-4 and is sent on to SEP-3 for further processing. A gaseous phase is removed from the top of SEP-4 (stream 7) and is commingled with the evolved hydrocarbon gas (stream 2) from SEP-1 prior to being sent to SEP-2.

A gaseous phase is removed from the top of SEP-2 (stream 8) and is cooled in heat exchanger EX-2 before being passed to separator SEP-5 where any liquid that condenses out of the gaseous phase in EX-2 is separated from the remaining gaseous phase (streams 16 and 10 respectively).

The gaseous phase 10 (stream 10) is compressed in compressor COMP-1 to form a high pressure gaseous stream 11 that is cooled in heat exchanger EX-1. Any liquid that condenses out of stream 11 is removed from the bottom of SEP-6 (stream 14). The remaining gaseous product is removed from SEP-6 via line 13.

The liquid phase withdrawn from the bottom of SEP-2 (stream 15) is commingled with streams 6 and 16 and optionally stream 14 and the combined stream 17 is passed to the first of 3 oil-water separators that are arranged in series (SEP-3, SEP-7 and SEP-8). A gaseous phase is removed overhead from both separators SEP-3 and SEP-7 (streams 18 and 23), and an aqueous phase from the bottom of each of the separators SEP-3, SEP-7, and SEP-8 (streams 19, 25, 29). The oil phase from SEP-3 is passed through heat exchanger EX-3 where the stream is heated against stream 31 (hot oil or other suitable heating medium such as hot air or steam) before being passed to separator SEP-7. The oil phase from SEP-7 is passed via lines 26 and 27 and PUMP-1 to SEP-8 where a dehydrated and degassed oil phase is removed via line 28.

As discussed above, a large separation vessel may be required upstream of the hydrate separation facility, to collect the multiphase fluids prior to processing (typically known as a slugcatcher) and to manage pipeline multiphase flow.

Figure 4:
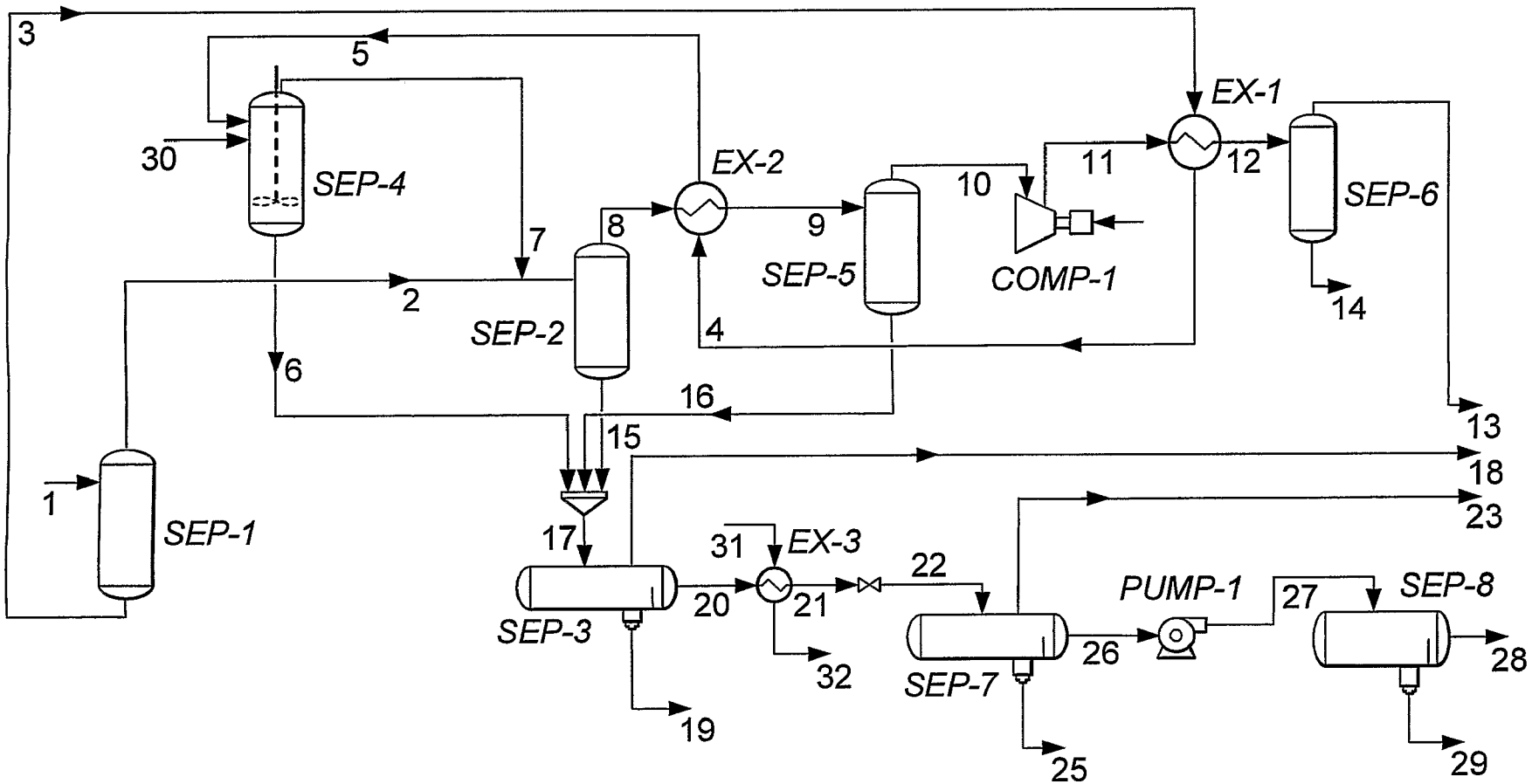

In FIG. 4, a feed stream comprising a gas hydrate slurry 1 is fed to a SEP-1 which is slurry concentration vessel (or cyclone). Vessel SEP-1 separates a concentrated hydrate slurry (stream 3) from a gaseous hydrocarbon stream 2, as described above for FIGS. 2 and 3. The gaseous hydrocarbon stream from SEP-1 is co-mingled with the disassociated gaseous phase (stream 7) produced in steam sparger SEP-4 (see below) and the combined gaseous stream is then sent on to SEP-2.

The concentrated slurry stream 3 from SEP-1 is warmed by heat exchange with hot process streams 11 and 8 in heat exchangers EX-1 and EX-2 and optionally with hot process stream 25 and 28 (this optional heat exchange is not shown) before being fed to the steam sparging vessel SEP-4 where the slurry is contacted with intermediate pressure (IP) steam (stream 30) to heat and re-gasify the hydrate particles contained within the slurry. Suitably, the IP steam has a pressure in the range 30 to 60 bar absolute. Preferably, the slurry is stirred within the steam sparger SEP-4 to aid heating of the slurry with the IP steam. A liquid phase (stream 6) is removed from the bottom of the steam sparger vessel Zone and is sent on to SEP-3 for further processing while, as discussed above, the gaseous phase that is withdrawn from the top of the steam sparger vessel SEP-3 (stream 7) is commingled with the evolved gas from SEP-1 prior to being sent to SEP-2.

The gaseous phase that is withdrawn from the top of SEP-2 (stream 8) is cooled in heat exchanger EX-2 (against the concentrated hydrate slurry stream 3) and is then passed to separator SEP-5 via line 9 where any liquid that condenses out of the gaseous phase in EX-2 is separated from the remaining gaseous phase (streams 16 and 10 respectively).

The gaseous phase 10 is compressed in compressor COMP-1 to form a high pressure gaseous stream 11 that is cooled in heat exchanger EX-1 (against the concentrated hydrate slurry stream 3). Any liquid that condenses out of stream 12 is removed from the bottom of SEP-6 (stream 14). The remaining gaseous product is removed from SEP-6 via line 13.

The liquid phase from SEP-2 (stream 15) is commingled with streams 6 and 16 and optionally with stream 14 before being passed to the first of 3 oil-water separators that are arranged in series (SEP-3, SEP-7 and SEP-8). A gaseous phase is removed overhead from both SEP-3 and SEP-7 (streams 18 and 23), and an aqueous phase from the bottom of each of the separators SEP-3, SEP-7 and SEP-8 (streams 19, 25, 29). The oil phase from SEP-3 (stream 20) is passed through heat exchanger EX-3 where the stream is heated against stream 31 (hot oil or other suitable heating medium such as hot air or steam) before being passed to separator SEP-7. The oil phase from SEP-7 is passed via lines 26 and 27 and PUMP-1 to SEP-8. A dehydrated and degassed oil phase is removed from SEP-8 via line 28.

As discussed above, a large separation vessel may be required upstream of the slurry separation facility, to collect the fluids prior to processing (typically known as a slugcatcher) and manage pipeline multiphase flow.

The invention claimed is:

1. A continuous process for regasifying a feed stream comprising (i) a slurry phase comprising gas hydrate particles suspended in a produced liquid hydrocarbon and optionally free produced water and (ii) optionally a gaseous phase comprising free produced gaseous hydrocarbon thereby generating a regasified multiphase fluid and for separating the regasified multiphase fluid into its component fluids, comprising the steps of:

(a) heating the feed stream to above the dissociation temperature of the gas hydrate thereby regasifying the feed stream by converting the gas hydrate particles into gaseous hydrocarbon and water;

(b) separating a gaseous hydrocarbon phase from the regasified multiphase fluid thereby forming a gaseous hydrocarbon product stream and a liquid stream comprising a mixture of liquid hydrocarbon and water;

(c) separating the liquid stream comprising a mixture of the liquid hydrocarbon and water into a liquid hydrocarbon phase and an aqueous phase; and (d) removing the liquid hydrocarbon phase as a liquid hydrocarbon product stream; wherein the feed stream is passed to a concentrator vessel of a regasification production facility prior to being heated in step (a) to above the dissociation temperature of the gas hydrate particles, wherein a gaseous phase comprising free gaseous hydrocarbon separates from the feed stream in the concentrator vessel and is removed from the concentrator as a gaseous hydrocarbon stream.

2. A process as claimed in claim 1 wherein the produced liquid hydrocarbon is a gas condensate or crude oil.

3. A process as claimed in claim 1 wherein the concentration of gas hydrate particles in the slurry phase of the feed stream is less than 50% by weight and the gas hydrate particles have a mean diameter of less than 250 μm.

4. A process as claimed in claim 1 wherein the regasification production facility additionally comprises (A) a dissociation vessel for heating the feed stream in step (a) to above the dissociation temperature of the gas hydrate; (B) at least one gas-liquid separator for separating the gaseous hydrocarbon phase from the regasified multiphase fluid in step (b); (C) at least one liquid hydrocarbon-water separator for separating the liquid stream comprising a mixture of liquid hydrocarbon and water in step (c) into a liquid hydrocarbon phase and an aqueous phase.

5. A process as claimed in claim 4 wherein the feed stream is at least partially heated in step, (a) by heat exchange with one or more hot process streams prior to being fed to the dissociation vessel wherein the hot process stream(s) is produced in the regasification production facility and/or in an integrated conventional production facility that is used for processing a conventional multiphase feed stream.

6. A process as claimed in claim 5 wherein the hot process stream is selected from:

(1) the regasified gaseous hydrocarbon stream that is formed in step (b);

(2) a hot compressed gaseous hydrocarbon stream from the regasification production facility and/or the integrated conventional production facility;

(3) a hot produced water stream from the liquid hydrocarbon-water separator of the regasification production facility and/or from a liquid hydrocarbon-water separator of the integrated conventional production facility;

(4) a hot liquid hydrocarbon product stream from the liquid hydrocarbon-water separator of the regasification production facility and/or from a liquid hydrocarbon-water separator of the integrated conventional production facility; and (5) a hot exhaust from a gas turbine of the regasification production facility and/or from a gas turbine of the integrated conventional production facility.

7. A process as claimed in claim 5 wherein heat exchange of the feed stream with one or more hot process streams in step (a) provides 5 to 100% of the heat input required to raise the temperature of the feed stream to at or above the dissociation temperature of the gas hydrate particles.

8. A process as claimed in claim 7 wherein heat exchange of the feed stream with one or more hot process streams in step (a) provides 25 to 75% of the heat input required to raise the temperature of the feed stream to at or above the dissociation temperature of the gas hydrate particles.

9. A process as claimed in claim 7 wherein heat exchange of the feed stream with one or more hot process streams in step (a) provides 45 to 55% of the heat input required to raise the temperature of the feed stream to at or above the dissociation temperature of the gas hydrate particles.

10. A process as claimed in claim 4 wherein the feed stream is heated to a temperature of at least 15° C. in the dissociation vessel.

11. A process as claimed in claim 10 wherein the feed stream is heated to a temperature of at least 25° C. in the dissociation vessel.

12. A process as claimed in claim 10 wherein the feed stream is heated to a temperature of at least 30° C. in the dissociation vessel.

13. A process as claimed in claim 4 wherein the feed stream is fed to the dissociation vessel at a pressure in the range 10 to 100 bar absolute.

14. A process as claimed in claim 13 wherein the feed stream is fed to the dissociation vessel at a pressure in the range 20 to 40 bar absolute.

15. A process as claimed in claim 4 wherein the residence time of the feed stream in the dissociation vessel is in the range 0.25 to 30 minutes.

16. A process as claimed in claim 15 wherein the residence time of the feed stream in the dissociation vessel is in the range 3 to 15 minutes.

17. A process as claimed in claim 4 wherein the dissociation vessel is a regasification boiler that heats the feed stream by heat exchange with a hot heat exchange fluid.

18. A process as claimed in claim 4 wherein the dissociation vessel is a warm water mixing vessel in which warm water is fed to the mixing vessel at a temperature in the range40 to 95° C., and the warm water is a hot produced water stream from the regasification production facility and/or from an integrated conventional production facility.

19. A process as claimed in claim 18 wherein the dissociation vessel is a warm water mixing vessel in which warm water is fed to the mixing vessel at a temperature in the range 50 to 60° C.

20. A process as claimed in claim 4 wherein the dissociation vessel is a steam sparger vessel and steam is sparged into the dissociation vessel at a pressure in the range 30 to 60 bar absolute.

21. A process as claimed in claim 1 wherein an aqueous slurry phase separates from the feed stream in the concentrator vessel and the aqueous slurry phase is withdrawn from the concentrator vessel and is passed to an aqueous slurry dissociation vessel wherein the aqueous slurry is heated to above the dissociation temperature of the gas hydrate particles thereby forming a gaseous hydrocarbon phase and a produced water phase.

22. A process as claimed in claim 21 wherein a produced water stream is withdrawn from the aqueous slurry dissociation vessel and is passed to an electrostatic coalescer wherein residual oil is removed from the produced water stream.

* * * * *